US007589688B2

(12) United States Patent
Pintos et al.

(10) Patent No.: US 7,589,688 B2
(45) Date of Patent: Sep. 15, 2009

(54) RADIATING SLOT PLANAR ANTENNAS

(75) Inventors: Jean-François Pintos, Bourgbarre (FR); Philippe Minard, Saint Medard sur Ille (FR); Ali Louzir, Rennes (FR)

(73) Assignee: Thomson Licensing, Boulogne-Billancourt (FR)

( * ) Notice: Subject to any disclaimer, the term of this patent is extended or adjusted under 35 U.S.C. 154(b) by 0 days.

(21) Appl. No.: 12/001,720

(22) Filed: Dec. 12, 2007

(65) Prior Publication Data

US 2008/0143623 A1 Jun. 19, 2008

(30) Foreign Application Priority Data

Dec. 18, 2006 (EP) ..... 0655584

(51) Int. Cl.
*H01Q 13/10* (2006.01)

(52) U.S. Cl. ..... 343/767; 343/768

(58) Field of Classification Search ..... 343/767, 343/768, 770

See application file for complete search history.

(56) References Cited

U.S. PATENT DOCUMENTS

| | | | | |
|---|---|---|---|---|
| 6,762,723 | B2 * | 7/2004 | Nallo et al. | 343/700 MS |
| 6,774,853 | B2 * | 8/2004 | Wong et al. | 343/700 MS |
| 7,132,992 | B2 * | 11/2006 | Mori | 343/770 |
| 7,403,161 | B2 * | 7/2008 | DiNallo et al. | 343/702 |
| 2007/0123181 | A1 * | 5/2007 | Bit-Babik et al. | 455/101 |

OTHER PUBLICATIONS

Huan-Shang Tsai et al.: "FDTD Analysis of CPW-Fed Floderd-Slot and Multiple-Slot Antennas on Thin Substrates" IEEE Transactions On Antennas And Propagation, IEEE Service Center, Piscataway, NJ, US vol. 44, No. 2, fevrier 1966 (Feb. 1996), XP011002666 ISSN: 0018-926X.

Moonil Kim et al.: "A Planar Parabola-Feed 1-7 Frequency Multiplier" IEEE Microwave And Guided Wave Letters, IEEE Inc., New York, US, vol. 7, No. 3, mars 1997 (Mar. 1997), XP011035155 ISSN: 1051-8207.

Weller T M et al: "Single And Double Folded-Slot Antennas On Semi-Infinite Substrates" IEEE Transactions On Antennas And Propagation, IEEE Service Center, Piscataway, NY, US vol. 43, No. 12 Dec. 1, 1995, pp. 1423-1428 XP000542129 ISSN: 0018-926X.

Tsai H S et al: "Planar Amplifier Array With Improved Bandwidth Using Folded-Slots" IEEE Microwave And Guided Wave Letters, IEEE Inc., New York, US vol. 4, No. 4 1 avril 1994 (Apr. 1, 1994), pp. 112-114 XP000442740 ISSN: 1051-8207.

* cited by examiner

*Primary Examiner*—Hoang V Nguyen
(74) *Attorney, Agent, or Firm*—Robert D. Shedd; Jeffrey M. Navon

(57) ABSTRACT

The present invention relates to a compact planar antenna containing, on a substrate featuring at least one ground plane, a radiating slot forming at least one folded strand with parallel strand parts. The antenna contains at least one means of phase inversion between two successive strand parts, the means of phase inversion being positioned on the strand in such a manner that the field components of the parallel strand parts are added together. The use of phase inversion means makes it possible to reduce the dimensions of the antenna, facilitating its integration on a card.

7 Claims, 6 Drawing Sheets

RADIATING SLOT PLANAR ANTENNAS

This invention relates to a compact planar antenna based on a radiating slot.

This application claims the benefit, under 35 U.S.C. §119, of European Patent Application No. 0655584 filed Dec. 16, 2006.

BACKGROUND OF THE INVENTION

At present, the development of mobile or nomadic terminals such as portable cellular phones, smart phones, PDAs standing for "Personal Digital Assistant" as well as the development of multimedia portable data terminals designed to receive television or related services, is growing steadily, using applications such as WIFI (Wireless Fidelity), WIMAX (Worldwide Interoperability for Microwave Access), DVB-T, DVB-H (Digital Video Broadcast) or other similar applications.

In order to receive these types of applications, the terminals are fitted with antennas, more specifically with antennas operating in the UHF frequency band, namely the band covering 470 MHz to 862 MHz frequencies, or in higher frequency bands.

In fact, a considerable bandwidth, the lowest frequency of the UHF band and compactness are major constraints for the design of an antenna that can be integrated in nomadic or mobile terminals.

Among the antennas that can be integrated, there are in particular planar antennas constituted by a radiating slot. However a radiating slot in linear shape etched in a ground plane presents a length modulo $\lambda g/2$ where $\lambda g$ is the guided wavelength in the slot at the operating frequency. Thus, as represented in FIG. 1, with a rectilinear slot 1 etched in a ground plane 2 produced on a known dielectric substrate and fed at 3 either directly through a coaxial or by using the known technique of electromagnetic coupling described by Knorr, all of the field lines radiate in phase and are oriented in the same direction, as symbolized by the arrows F.

In a known fashion and as represented in FIG. 2 for a 2.4 GHz radiating slot, the orientation of the field lines is due to the current induced through the length of the slot, said currents being symbolized by the current vectors V through the length of the slot 1 of FIG. 2.

The design represented in FIG. 1 and FIG. 2 is the design of a 2.4 GHz radiating slot in a finished ground plane of a dimension of 111.2 mm×60.5 mm. In this case, the dielectric substrate chosen is the known substrate Rogers 4003, whose physical parameters are thickness 0.8 mm, permittivity $\in r=3.38$ and loss tangent $\delta=0.0027$.

In the case of FIGS. 1 and 2, the slot is excited by a microstrip line 3 short circuited at its extremity. This type of excitation obeys the conditions for coupling a microstrip line to a slot line as defined by Knorr (refer to article J. B. Knorr "Slot lined transition" IEEE Trans. Microwave Theory and Techniques, pages 548-554, May 1974). In this case, the characteristics of the slot are as follows:

slot length: 42.4 mm ($\sim\lambda g/2$), slot width: 0.5 mm.

As the person skilled in the art knows, this slot presents a non-negligible length, depending on the operating frequency, which makes this type of antenna difficult to integrate in a mobile terminal. Owing to this fact, in order to reduce the overall dimension and as shown in FIG. 3, it is a known practice to bend the strands 10*a*, 10*b* of the slot 10 into a spiral. However, as it will be explained in a more detailed manner hereinafter, the radiating efficiency of such a radiating slot decreases significantly.

In FIG. 3, we have shown a slot 10 etched in the ground plane 11 of a dielectric substrate. This slot 10 is fed in its middle portion 12 by a microstrip line, according to a Knorr type feed. This slot contains two strands 10*a*, 10*b* which have each one been noticeably folded into a rectangular shape open at the end of the strand. This specific shape of the strands 10*a*, 10*b* makes it possible to limit the total overall size of the antenna. In this case, the longitudinal dimension is reduced from 42.4 mm to 9.5 mm for a length of 8.05 mm in the perpendicular direction.

As represented in FIG. 4 which gives the efficiency according to the frequency respectively for an antenna in accordance with FIG. 1 and an antenna in accordance with FIG. 3, with the dimensions given above, a fall is noticed in radiating efficiency at 2.4 GHz which passes from around 95% to 50%. This is explained by the fact that when the strands 10*a* or 10*b* are bent, the field lines in the parallel parts of the antenna, as represented by the arrows F1 and F2 in FIG. 3, noticeably cancel each other out, which decreases the radiating efficiency of this type of antenna.

SUMMARY OF THE INVENTION

The present invention therefore relates to a planar slot antenna equipped with means which make it possible to remedy, in particular, this loss in radiating efficiency.

Thus, the present invention relates to a compact planar antenna comprising, on a substrate featuring at least one ground plane, a radiating slot forming at least one folded strand with parallel strand parts, characterized in that it comprises at least one means of phase inversion between two successive strand parts, the means of phase inversion being positioned on the strand in such a manner that the field components of the parallel strand parts are added together.

According to one embodiment, the means of phase inversion is constituted by two bridges linking the two edges of the slot in the shape of a cross, the ground plane containing at the level of the means of inversion, means forming open circuits. Preferably, both bridges are constituted by microstrip lines etched in two different planes of the substrate.

According to another embodiment, the bridges can be made with discrete elements connecting both rims of the slot.

According to one embodiment of the invention, the means forming open circuits are made up of slots in the ground planes.

According to another characteristic of the present invention, the ground plane consists of non-metallized zones whose objective is to prevent the spurious resonance which can come from the length of the cutouts in the ground plane to render the circuits open-circuit. The slots of the ground plane or cutouts open out into these non-metallized zones.

According to another characteristic of the invention, for operation in the UHF band, the substrate containing both strands of the antenna is folded over on itself.

BRIEF DESCRIPTION OF THE DRAWINGS

Other characteristics and advantages of the present invention will emerge upon reading the description of different embodiments, this description being realized with reference to the enclosed drawings, wherein.

To simplify the description in the figures, the same elements have the same references.

DESCRIPTION OF PREFERRED EMBODIMENTS

Figure 3:
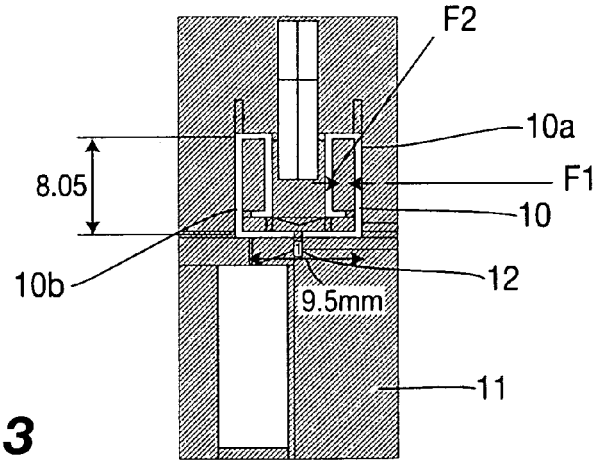
FIG. 3 which has already been described is a diagrammatic plan view of a slot antenna according to another embodiment.
Figure 4:
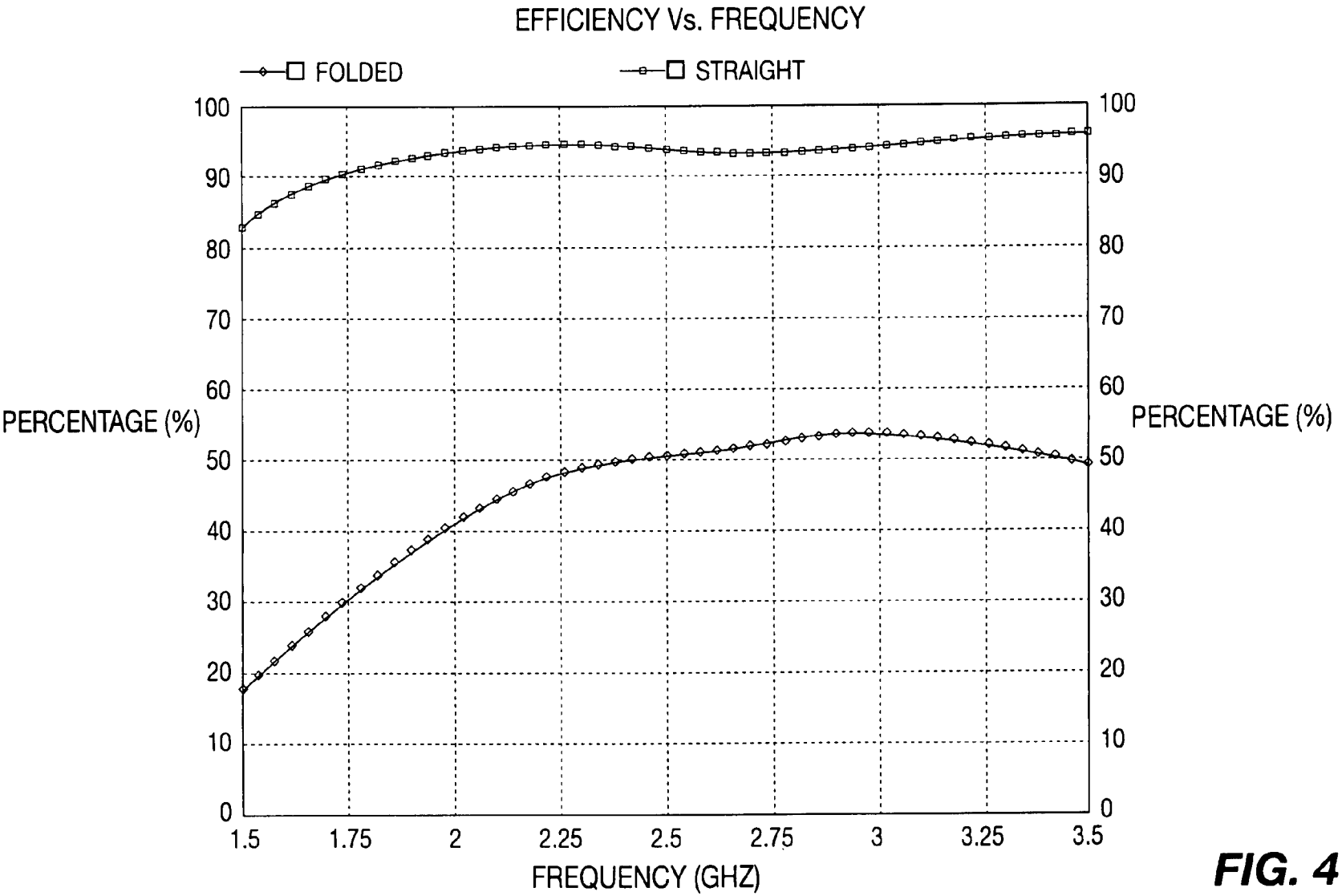
FIG. 4 represents the curve giving the radiating efficiency according to the frequency for operation at 2.4 GHz, respectively of the antenna of FIG. 1 and the antenna of FIG. 3.
Figure 5:
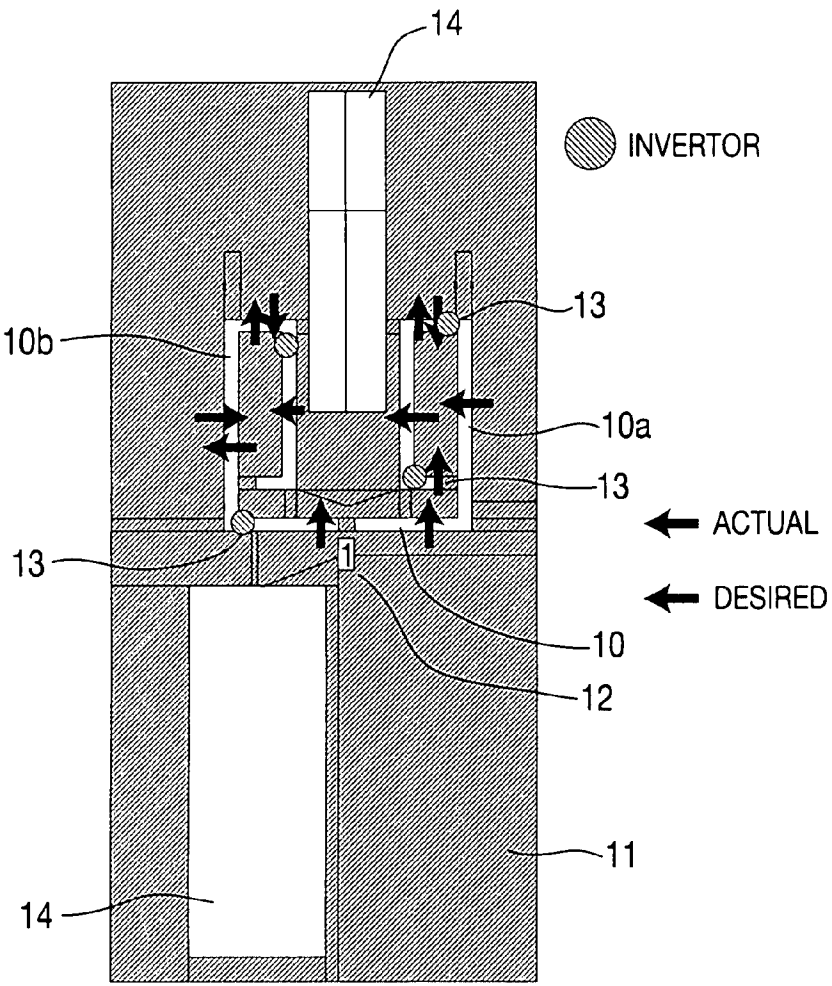
FIG. 5 is a diagrammatic top plan view of a slot antenna in accordance with the present invention.

A description will first be given with reference to FIGS. 5 to 8 OF a first embodiment of this invention. In FIG. 5, the main elements which have already been described with reference to FIG. 3 are found, namely on a metallized substrate 11, a slot antenna 10 comprising two strands 10*a* and 10*b* which have been noticeably folded according to a rectangle. This slot is fed by a microstrip line 12 by using, in this case, the Knorr principle. Moreover, as represented in FIG. 5, the ground plane 11 has two non-metallized zones 14, the purpose of these two non-metallized zones being to form open circuits enabling spurious resonance to be prevented.

In accordance with this invention, four phase invertors 13 symbolized by circles have been positioned on the strands 10*a* and 10*b* of the slot in such a manner that the electrical field in the strand parts which are noticeably parallel is added together, as represented by the arrows S for the desired field, while the arrows A represent the actual field. Hence, on the arm 10*a*, a phase invertor is positioned at the level of the second bend and then the fourth bend whereas on the arm 10*b*, a phase invertor is positioned at the level of the first bend and the third bend. Consequently, with the orientation of the field represented in FIG. 5, all the field components are added together.

A description will be given with reference to FIGS. 6 and 7 of a first embodiment of the phase invertor. In this case, the invertors 13 are formed by bridges between two successive parts of the slot 10.

Figure 7:
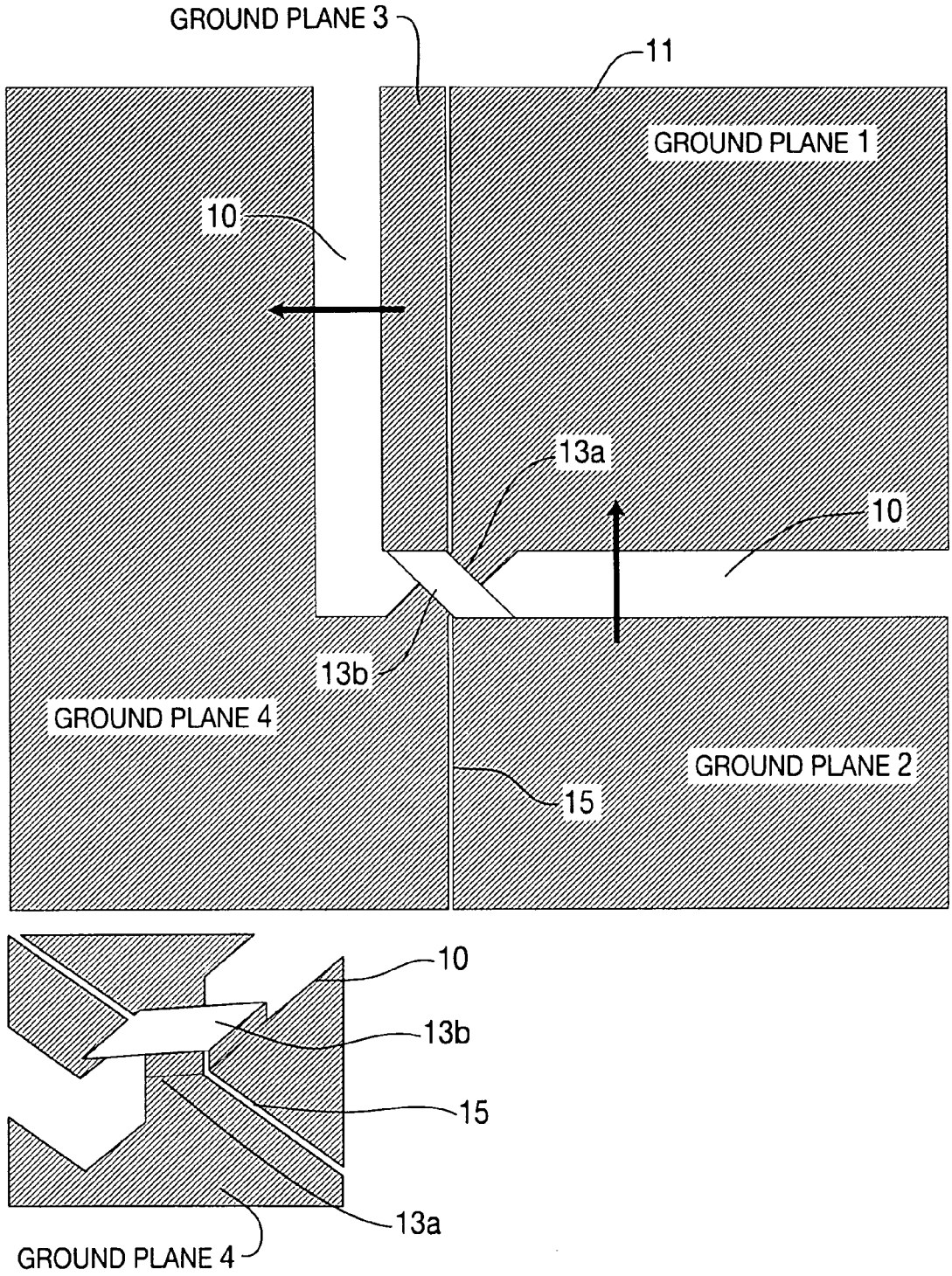
FIG. 7 is an overall and enlarged top view, showing the means of phase inversion, in accordance with the present invention.

In a more specific manner and as shown in FIG. 7, at the level of a bend of the slot 10, a first bridge 13*a* is made by etching a thin line connecting one edge of the slot to its other edge while a second bridge 13*b* connects both the edges of the slot 10 according to another plane of the substrate, either with the help of a metal line added between both edges (bonding) or realised in another conducting plane of the substrate or produced by means of a discrete component (resistance 0 Ohm).

Figure 6:
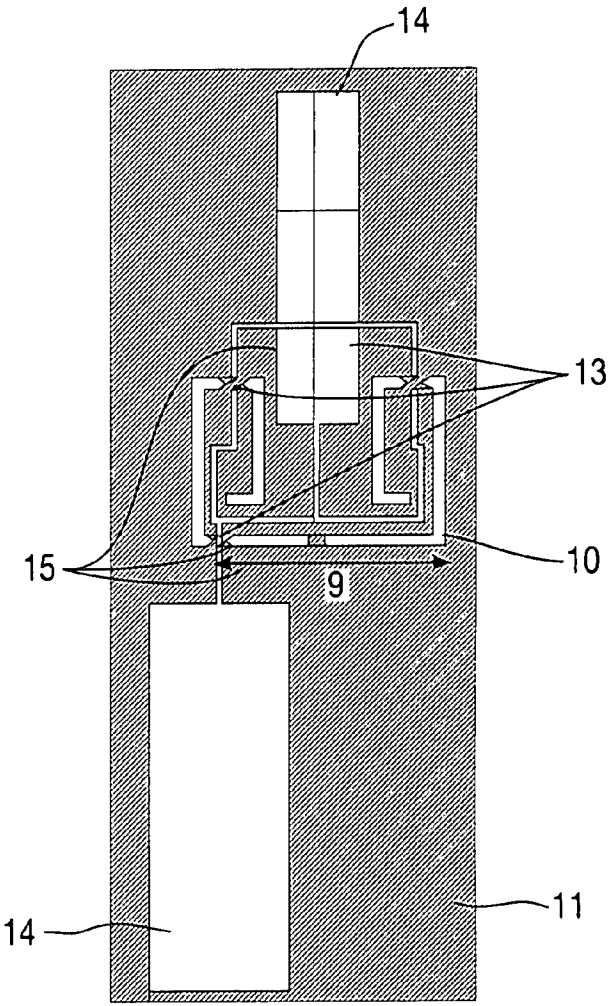
FIG. 6 is a top view of a first embodiment of an antenna in accordance with the present invention.

As shown in FIGS. 6 and 7 at the level of the bridges, in the ground plane, slots (cutouts) 15 are provided which in fact divide this ground plane into several sub-planes referenced in FIG. 7, ground plane 1, ground plane 2, ground plane 3 and ground plane 4. This slot (cutout) enables to put the currents induced on two neighbouring ground planes (ground planes 1 and 3, respectively 2 and 4) into phase opposition; it is linked to the non-metallized zones 14 of FIG. 6.

By using these invertors and as represented in a clearer manner in FIG. 7, the radiating slot is made up of two conductors, namely the ground plane 1 and the ground plane 2, with sufficient distance to allow the propagation of current through the entire length of this slot line. When we geometrically invert the currents through the length of the radiating slot by connecting the ground plane 1 to the ground plane 4 through a conductive line referenced in 13*a* on the same level as the radiating slot, the orientation of the field is changed by 180°. Similarly, the ground plane 2 is connected to the ground plane 3 by a line 13*b* having an identical width to that of line 13*a*, by crossing another layer of the substrate. The slot or cutout 15 allows the polarities of the currents induced through the length of the radiating slot 10 to be changed.

Figure 1:
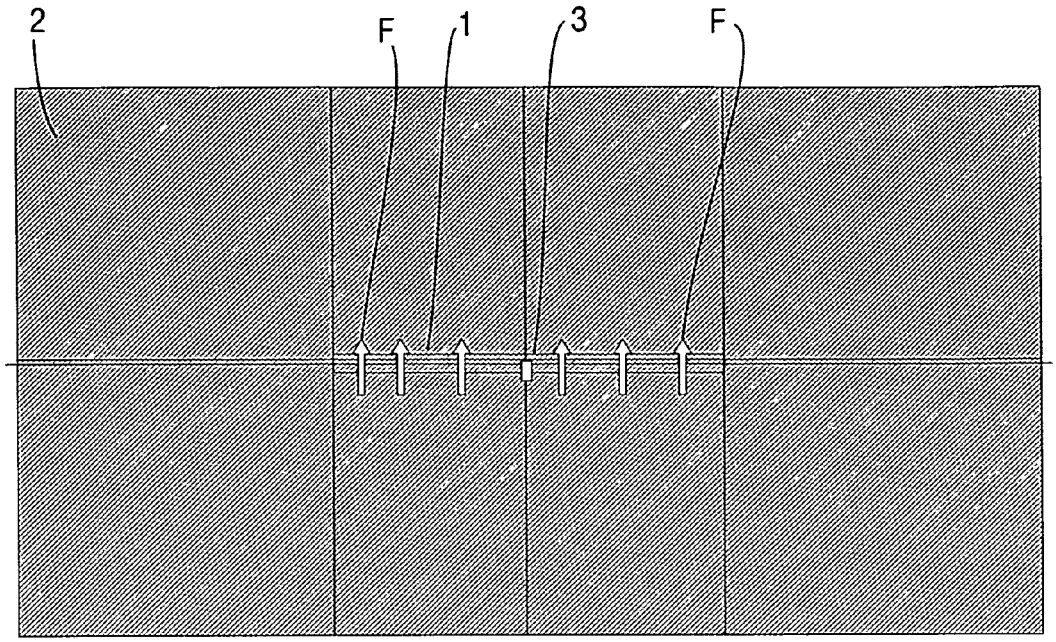
FIG. 1 which has already been described is a diagrammatic top plan view of a radiating linear slot antenna according to prior art.
Figure 2:
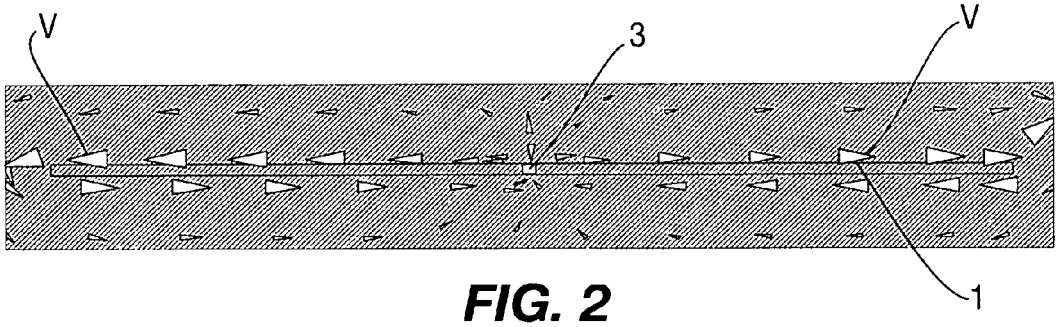
FIG. 2 is an enlarged diagrammatic view of the antenna of FIG. 1 explaining the operation of a radiating linear slot antenna.
Figure 8:
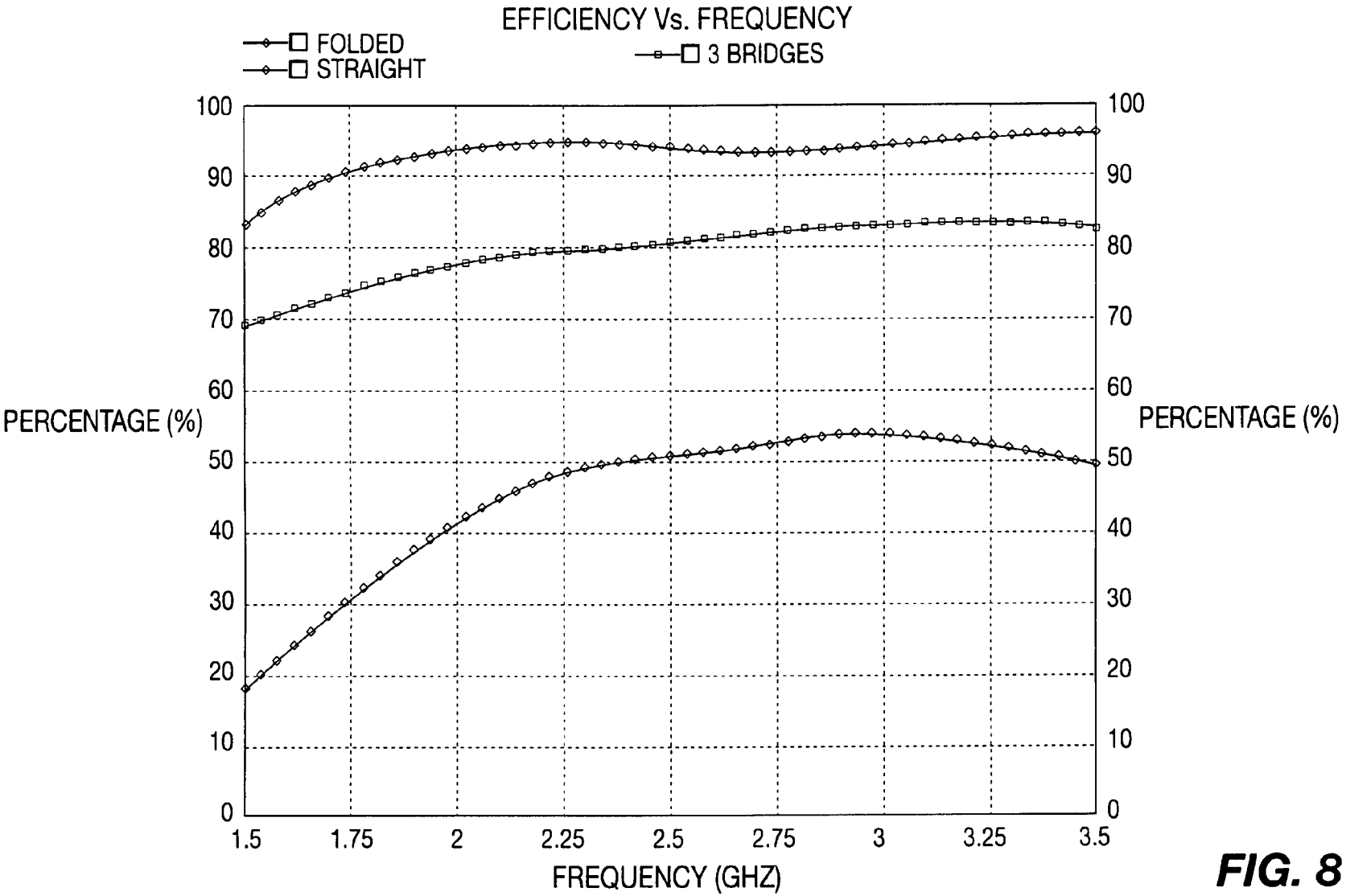
FIG. 8 is a curve which gives the efficiency according to the frequency respectively for the antenna of FIG. 1, the antenna of FIG. 3 and the antenna of FIG. 6.

The simulations carried out on the three types of antennas represented respectively in FIG. 1, FIG. 3 and FIG. 6 have given the radiating efficiency curves according to the frequency, as represented in FIG. 8.

In this case, it is seen that the efficiency obtained with the invertor bridges is a notable improvement in relation to the antenna constituted by a slot line whose strands are folded, as represented in FIG. 3. Furthermore, with the phase invertors, the size of the slot can be reduced in an even more considerable manner since we get, for an antenna operating at 2.4 GHz, a size of 6.3×9.5 $mm^2$.

Another embodiment of this invention used in particular for realizing a folded slot antenna operating in the UHF band will now be described with reference to FIG. 9.

Figure 9:
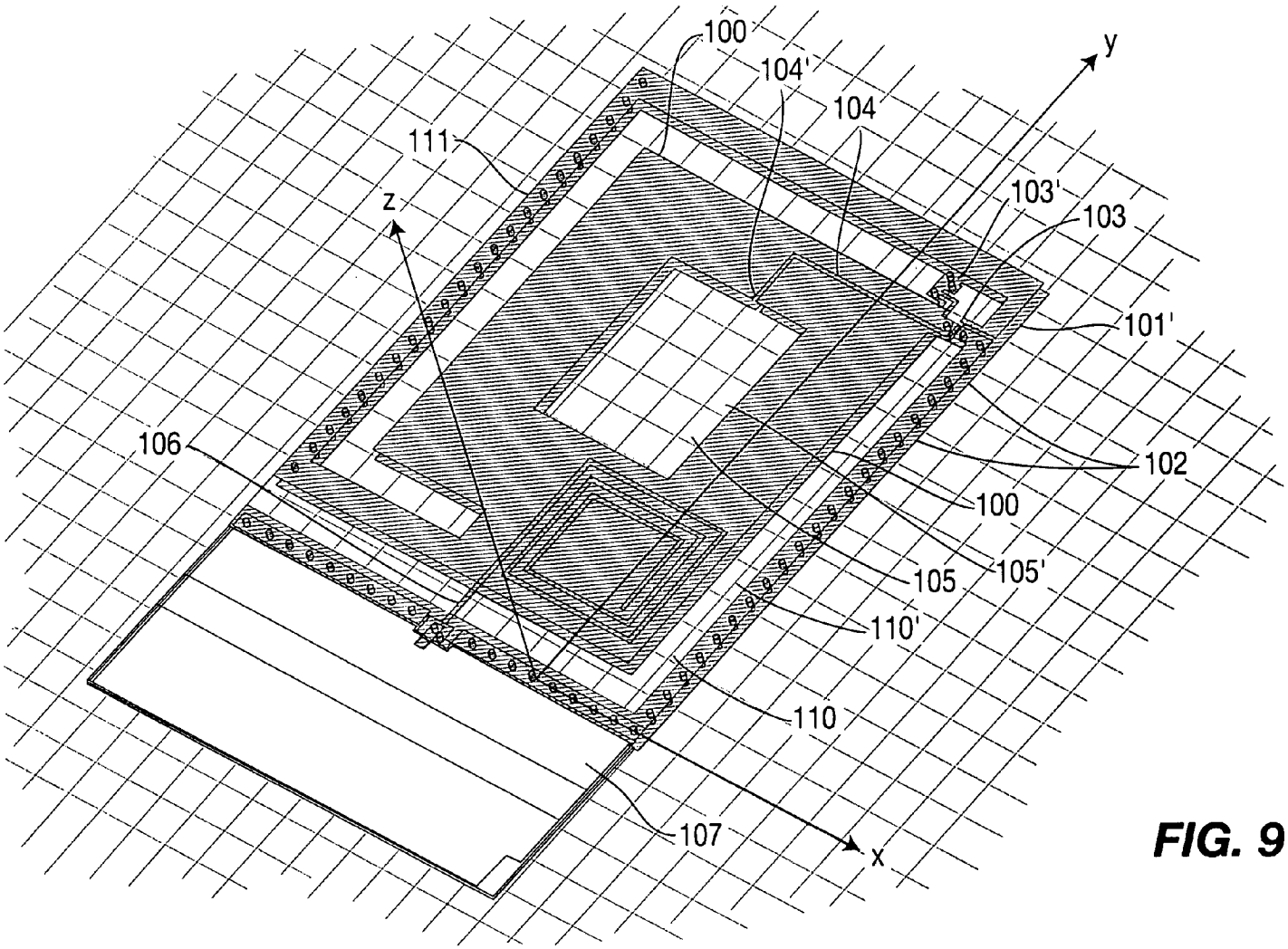
FIG. 9 is a perspective view of another embodiment of an antenna in accordance with the present invention, operating in the UHF band.

In this case and as shown in FIG. 9, a slot 110, 110' whose strands have been noticeably folded into the shape of a rectangle has been etched on two substrate parts 100, 100'. In this case, for limiting the size of the antenna, the substrates 100, 100' are placed one on top of the other and each one connected to the other according to their edge 101, 101' through conductive pins 102.

As shown in FIG. 9, the slot 110 is fed by a triplate line 106 which opens out on the substrate 107. The substrate is based on an FR4, multi-layer Er=4.5, tan D=0.02. In the present case, the external layers are used for printing the contours of the slot and only one internal layer is used for the triplate excitation line. The extremity of the triplate excitation line is not short-circuited as on the preceding diagrams but has a length such that the coupling is optimal for the UHF band.

In accordance with the present invention, phase invertors 103, 103' are realized in each part of the slot 110 at the level of one of the bends of the slot. These phase invertors 103, 103' are respectively constituted by a metallic line connecting one of the edges of the slot 110 to its opposite edge, this metallic line being located in the same plane as the ground plane 100, 100' and by another metallic line connected by another metallic bridge in another layer of the substrate, this other bridge being connected to both edges of the slot through metallic pins.

As shown in FIG. 9, each ground plane 100, 100' features a slot 104, 104' which opens out on a non-metallized zone 105, 105' of the ground planes 100, 100'. This structure makes it possible to realize a compact antenna capable of operating in the UHF band and of being easily integrated on the card of a mobile terminal. The studs 111 at the level of the bend ensure floor continuity between both the external levels of the slot.

The antennas described above have a certain number of advantages. A very good radiating efficiency is thus obtained in comparison with a standard folded slot. Moreover, this type of antenna can be easily integrated to consumer products owing to its planar structure. Furthermore, a radio-frequency circuit can be easily integrated on the same card as the antenna since the technology used is a printed technology. This solution is a low cost solution using a printed technology on a low cost substrate. One can thus obtain compact antennas with dimensions in the order of 0.22 λg at the central operating frequency.

What is claimed is:

1. A compact planar antenna containing, on a substrate fitted with at least one ground plane, a radiating slot forming at least one folded strand (10*a*, 10*b*) with parallel strand parts, with at least one means of phase inversion between two successive strand parts, the means of phase inversion being positioned on the strand in such a manner that the field components of the parallel strand parts are added together.

2. Antenna according to claim 1, wherein the means of phase inversion is constituted by two bridges linking the two edges of the slot in the shape of a cross, the ground plane comprising, at the level of the means of inversion, means forming open circuits.

3. Antenna according to claim 2, wherein the means forming open circuits are constituted by slots or cutouts in the ground plane.

4. Antenna according to claim 3, wherein the ground plane comprises non-metallized zones.

5. Antenna according to claim 2, wherein the bridges are realized by discrete elements connecting both edges of the slot.

6. Antenna according to claim 2, wherein the bridges are realized by microstrip lines etched in two different plans of the substrate.

7. Antenna according to claim 1, wherein the substrate comprising both strands of the antenna is folded over on itself.

* * * * *